US007338231B2

(12) United States Patent
Masters

(10) Patent No.: US 7,338,231 B2
(45) Date of Patent: Mar. 4, 2008

(54) BOAT HOIST

(75) Inventor: K. Gregg Masters, Metamora, MI (US)

(73) Assignee: Multi Automated Products, Flint, MI (US)

( * ) Notice: Subject to any disclaimer, the term of this patent is extended or adjusted under 35 U.S.C. 154(b) by 18 days.

(21) Appl. No.: 11/364,125

(22) Filed: Feb. 28, 2006

(65) Prior Publication Data

US 2006/0196401 A1 Sep. 7, 2006

Related U.S. Application Data

(60) Provisional application No. 60/657,790, filed on Mar. 2, 2005.

(51) Int. Cl.
*B63C 3/00* (2006.01)

(52) U.S. Cl. ..... 405/3

(58) Field of Classification Search ..... 405/1, 405/3; 114/44

See application file for complete search history.

(56) References Cited

U.S. PATENT DOCUMENTS

| | | | | |
|---|---|---|---|---|
| 3,238,733 | A | 3/1966 | Kreis | |
| 3,592,294 | A | 7/1971 | Allen | |
| 3,675,258 | A | 7/1972 | Osmundson | |
| 3,697,048 | A | 10/1972 | Samo | |
| 4,022,027 | A * | 5/1977 | Tetzner | 405/3 |
| 4,109,896 | A | 8/1978 | Ragen | |
| 4,401,335 | A | 8/1983 | Godbersen | |
| RE32,118 | E | 4/1986 | Godbersen | |
| 4,595,313 | A | 6/1986 | Kotke | |
| 4,787,327 | A * | 11/1988 | Porter | 114/44 |
| 4,850,741 | A | 7/1989 | Timmerman | |
| 5,240,347 | A | 8/1993 | Williams et al. | |
| 5,641,242 | A * | 6/1997 | Riviere | 405/3 |
| 5,687,663 | A * | 11/1997 | Wahlstrand | 114/44 |
| 5,755,529 | A | 5/1998 | Follett | |
| 6,575,661 | B1 | 6/2003 | Phillips et al. | |
| 6,709,197 | B1 | 3/2004 | Sargent et al. | |
| 6,830,002 | B1 | 12/2004 | Walker | |
| 6,846,129 | B1 * | 1/2005 | Edson | 405/3 |

* cited by examiner

*Primary Examiner*—Frederick L. Lagman
(74) *Attorney, Agent, or Firm*—Warn Partners, P.C.

(57) ABSTRACT

A boat hoist utilizing a lightweight frame for support of a moving platform, which traverses the frame lifting the watercraft above the surface of the water. Minimal force applied to a single hand wheel on a winch, and pulley system with a flexible cable, will provide the drive to lift and lower the moving platform. This invention distributes the load between the four-roller assemblies without creating undue torsional and/or twisting force to the moving platform, the load is carried by roller assembly and frame and not solely the flexible cable. The dual inclined roller surface, pulley system, and roller wheels reduce the force required to raise the platform. Legs support the lightweight frame assembly, and are adjustable to accommodate uneven terrain on the bottom surface. This system utilizes fewer flexible cables and moving parts than traditional systems, as well as all moving parts remain above the waterline during storage for improved reliability and reduced maintenance.

11 Claims, 3 Drawing Sheets

FIG - 3
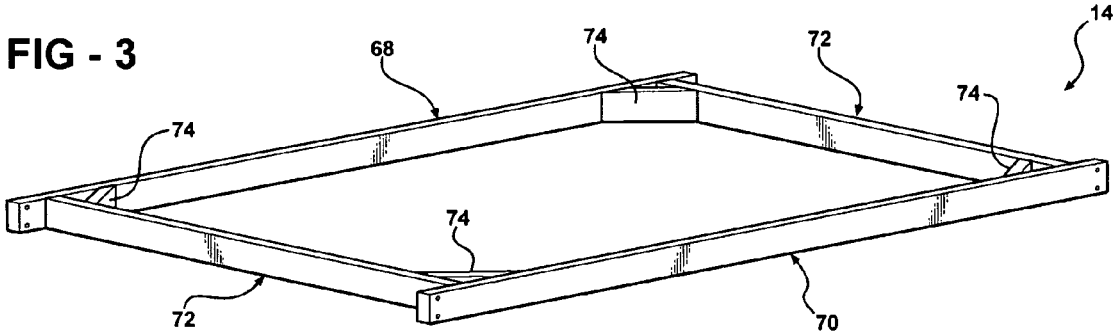
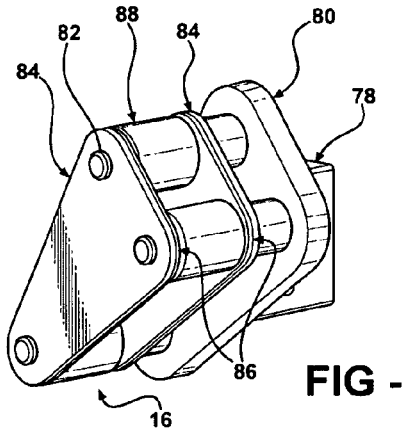
FIG - 4A
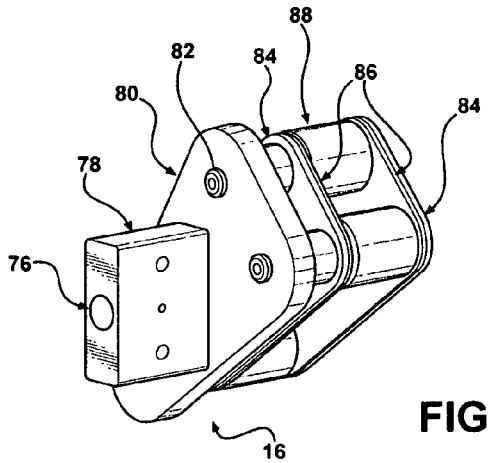
FIG - 4B

BOAT HOIST

CROSS-REFERENCE TO RELATED APPLICATIONS

This application claims the benefit of U.S. Provisional Application No. 60/657,790, filed Mar. 2, 2005. The disclosure of which is incorporated herein by reference.

FIELD OF THE INVENTION

The present invention relates in general to lifting devices for the purpose of raising and storing watercraft, specifically to a boat hoist utilizing a novel load distribution system.

BACKGROUND OF THE INVENTION

Existing lift mechanisms incorporate various methods to elevate a watercraft. The following U.S. Patents exemplify current systems and technology in the boat hoist market:

U.S. Pat. No. 4,850,741 illustrates and describes a boat hoist having a hydraulic powered, cantilevered supported lifting mechanism.

U.S. Pat. No. 32,118 illustrates and describes a boat hoist having a vertical lifting system utilizing multiple cables, pulleys and winch as a drive and support system.

U.S. Pat. No. 4,109,896 illustrates and describes a boat hoist having a scissors supported lifting system, driven by multiple cables, pulleys and a winch.

U.S. Pat. No. 4,595,313 illustrates and describes a boat hoist system utilizing a single inclined plane as support, driven by multiple cables, pulleys, counter balance, floatation material, and a winch.

U.S. Pat. No. 3,238,733 illustrates and describes a boat elevator utilizing dual inclined plane rail beds for support, powered by an electric motor, gear box and cable system.

Existing boat hoist assemblies often incorporate complex mechanisms with a large number of parts which make it difficult to assemble and maintain. Additionally, the complexity of these designs will effect the reliability of the hoist. Thus it is desirable to develop a boat hoist having fewer numbers of moveable parts, which are more simple in design and resist fatigue and wear.

SUMMARY OF THE INVENTION

A hoist having two vertical frames forming the two sides of the hoist, each of the two vertical frames having a lower portion and an upper portion. One or more cross tubes connects to the two vertical frames with one or more diagonal tubes mounted to the one or more cross tubes. Each diagonal tube is positioned at an angle with respect to the lower portion of the two vertical frames. A platform is slidably connected to the diagonal tubes and serves as a track for sliding the platform along the length of the diagonal tubes. One or more roller assemblies are connected between the platform and the diagonal tubes for the purpose of facilitating the sliding movement of the platform along the length of the diagonal tubes.

The boat hoist is to provide a system, which will safely store watercraft with ease of operation.

The boat hoist also provides a system with fewer parts therefore improving assembly and maintenance required. Additionally the hoist uses a roller wheel assembly that provides consistent reliability.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 3 a perspective view of the moving platform; and

FIGS. 4A and 4B show detailed views of the roller support system.

DETAILED DESCRIPTION OF THE PREFERRED EMBODIMENTS

Figure 1:
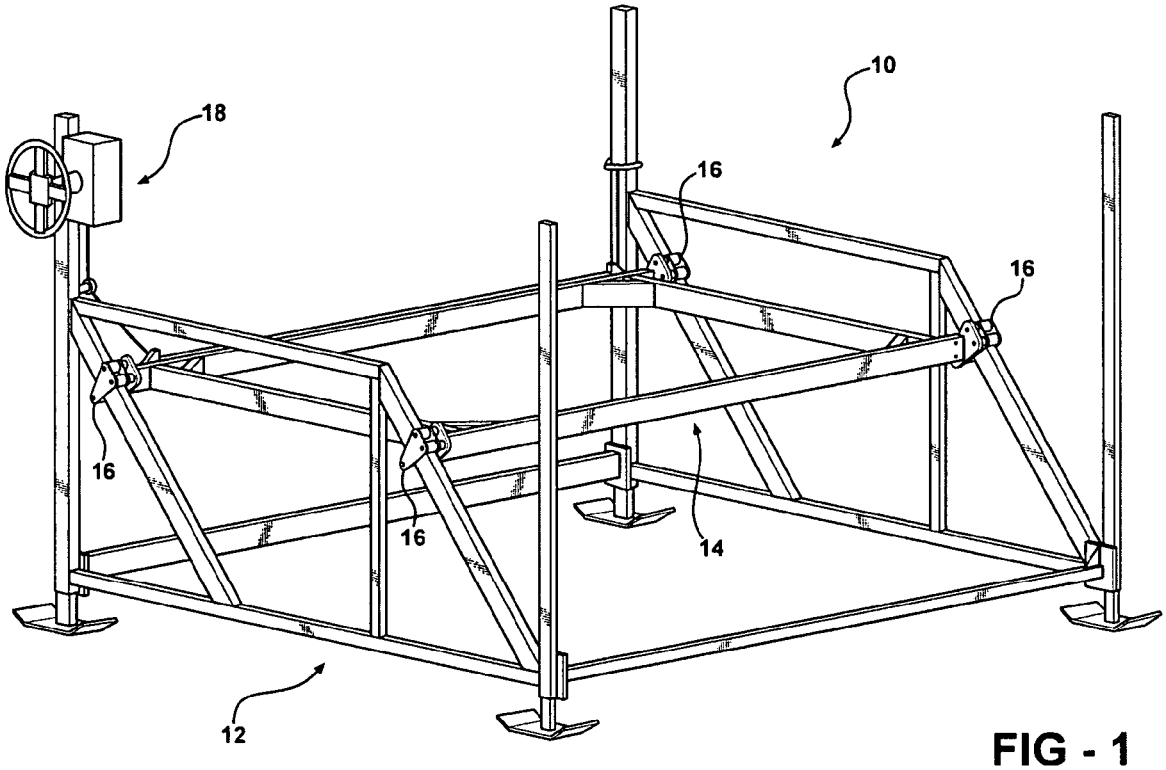
FIG. 1 a perspective view of the boat hoist assembly.

The following description of the preferred embodiment(s) is merely exemplary in nature and is in no way intended to limit the invention, its application, or uses.

Referring now to FIGS. 1-4 a boat hoist 10 is shown as having a mainframe 12, moving platform 14, roller assembly units 16 and a drive assembly or suspension system 18.

Figure 2:
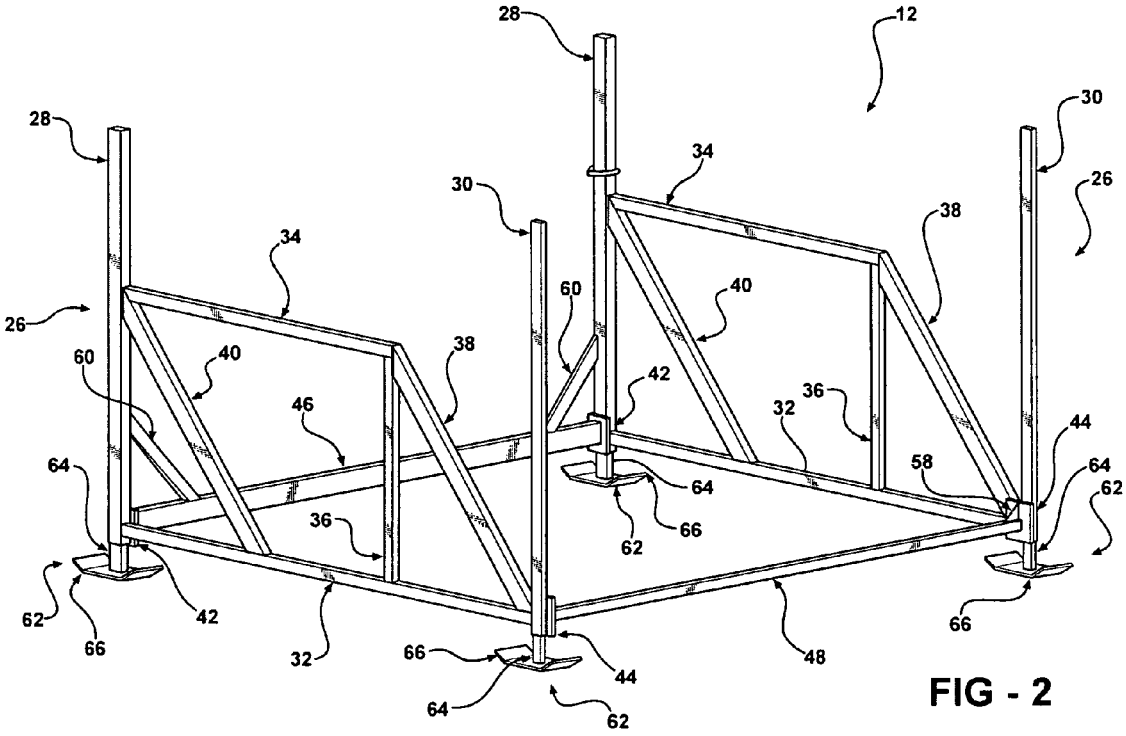
FIG. 2 a perspective view of the boat hoist main frame.

FIG. 2 illustrates a perspective view of the main frame 12 which has two vertical side frames 26 which are a welded construction of extruded aluminum tubing material. The two vertical sides 26 are identical in material and construction except that one is a right hand and one is a left hand.

Each vertical side frame 26 is constructed of a front vertical tube 28 and rear vertical tube 30 connected longitudinally across the bottom by lower tube 32. Across the top of each side frame 26 is a top tube 34 that connects to front vertical tube 28 and a center vertical tube 36, and a rear diagonal tube 38. A front diagonal tube 40 is connected at the intersection of front vertical tube 28 and top tube 34 at one end. The second end of front diagonal tube 40 is connected to lower tube 32.

Front attachment plates 42 are attached to the side frame assembly at the intersection of the front vertical tube 28 and the lower tube 32. The rear attachment plates 44, are attached to the side frame weldment assemblies at the intersection of rear vertical tube 30 and lower tube 32.

The two side frames 26 are cross connected in the front by a front cross tube 46 and in the rear by a rear cross tube 48. Front cross tube 46 is constructed of a center rectangular tube and the two front attachment plates 42. Rear cross tube 48 is constructed of a center rectangular tube and two rear attachment plates 44 as well as two rear gusset reinforcements 58. The two front vertical tubes 28 are cross-braced back to the front cross tube 46 using a front cross brace 60.

The entire main frame 12 may be elevated by inserting extension legs 62 into front vertical tube 28 and rear vertical tube 30. Extension legs 62 are constructed of tube 64 with a pattern of holes to allow for adjustment and foot plate 66 which is welded to tube 64. This is allows the boat hoist 10 to be installed in a body of water that has a sediment bottom that would cause the boat hoist 10 to sink considerably before settling. Additionally, the foot plates 66 have a larger surface area, which will aid in preventing the boat hoist 10 from sinking. As shown foot plate 66 also has an angled end which aids in the sliding of the boat hoist 10 during installation and removal of the boat hoist 10.

FIG. 3 illustrates a perspective view of the moving platform 14. The moving platform 14 is constructed of extruded rectangular aluminum. The moving platform 14 has a welded construction formed of a front tube 68, a rear tube 70, two cross tubes 72 and four corner gussets 74. The moving platform 14 is slidably connected to the main frame 12 using roller assemblies 14, as shown in FIG. 1. In operation the moving platform 14 is configured to support a vehicle, such as a boat, jet ski or other water craft. While not shown, it is within the scope of the invention to place skids or other suitable supports on the moving platform 14 in order to support the shape of the vehicle that will placed on the moving platform 14. Additionally, it is also within the scope of this invention to have additional cross tubes in order to have a moving platform 14 that will support a greater amount of weight or multiple vehicles.

FIGS. 4A and 4B illustrate the detail of the roller assemblies 16. FIG. 4 shows two different views of the roller assemblies 16. Each roller assembly 16 has a platform shaft 76, a platform shaft adapter 78, a roller housing 80, a roller wheel 82, a spacer plate 84, a wear plate 86 and a roller wheel 88. Each individual front and rear diagonal tubes 40, 38 as shown in FIG. 1 has a roller assembly 16 attached to allow the platform 14 to roll along the length of the front and rear diagonal tubes 40, 38. Each corner of the moving platform 14 has a roller assembly 16 attached. The front and rear diagonal tubes 40, 38 are configured to be slidably positioned below the roller wheel 88 and between the wear plates 86. While this particular embodiment shows only a single roller wheel 88 it is possible to have a greater number of roller wheels combined with a larger roller assemblies 16 in order to hold a greater amount of weight or to distribute the weight of the vehicle across a larger surface area. The platform shaft adapter 78 is configured to receive a platform shaft that is connectable with the moving platform 14. This allows for ease of attachment of the roller assemblies 16 to the moving platform 14.

FIG. 1 illustrates the assembly of all components of the boat hoist 10 as well as the operational aspects of the system. The drive assembly 18 has a controller 20 that is mounted to one of the front vertical tubes 28. In this particular instance the controller 20 is a manual winch mechanism, however, it is within the scope of this invention for the controller 20 to be an electrically operated motor or other suitable actuation device. The controller 20 has a drum assembly contained therein for winding flexible cables 24 which are connected at two locations on the moving platform 14. The controller 20 provides the force for sliding the platform 14 along the length of the front and rear diagonal tubes 40, 38. The flexible cables 24 are threaded through several wheels 22 mounted to various portions of the main frame 12 which guide the cables 24 as they are wound and unwound within the controller 20.

Variations and modifications of the present invention may be applied to accommodate watercraft of different sizes and weights, these changes in no way alter the claims made, and are within the scope of the present invention.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A hoist comprising:

a first vertical frame having a lower portion and an upper portion with two diagonal tubes mounted on said first vertical frame each extending parallel in relation to each other and having one end attached to said lower portion and a second end attached to said upper portions;

a second vertical frame having a lower portion and an upper portion with two diagonal tubes mounted on said first vertical frame each extending parallel in relation to each other and having one end attached to said lower portion and a second end attached to said upper portions;

one or more cross-tubes connecting said lower portions of said first vertical frame and said second vertical frame; and a platform extending between said first vertical frame and said second vertical frame, wherein each end of said platform positioned adjacent said first and second vertical frames is connected to said first and second diagonal tube of each of said first vertical frame and said second vertical frame, wherein said platform is configured to roll along the length of said first and second diagonal tubes.

2. The hoist of claim 1 further comprising a roller assembly connected to each diagonal tube, wherein said roller assemblies are also connected to said platform, wherein said roller assemblies facilitate the simultaneous movement of said platform along said first and second diagonal tubes on said first vertical member and said first and second diagonal tubes on said second vertical member.

3. The hoist of claim 2 further comprising a suspension system operably connected to said platform for allowing variation of location and amount of load applied to the platform, without undue stress and fatigue to the structure of said platform and two vertical frames.

4. The hoist of claim 3 wherein said suspension system comprises a winch connected to said first vertical frame, one or more wheels connected to said first vertical frame and a flexible cable connecting at one end to said winch and at a second end to said platform member.

5. The hoist of claim 2 wherein said roller assemblies have one or more rollers contacting said diagonal tube for distributing weight on said diagonal tube.

6. A hoist comprising:

a first vertical side frame having a front vertical tube, a rear vertical tube and a center vertical tube positioned between said front and said rear vertical tubes, a lower tube connecting said front, center and rear vertical tubes at their lower ends, a top tube connected at a first end to said front vertical tube and at a second end to said center vertical tube, a front diagonal tube connected at an angle having a first end connected to said front vertical tube and a second end connected to said lower tube, a rear diagonal tube extending at an angle parallel to said front diagonal tube, wherein said rear diagonal tube has a first end connected to said center vertical tube and a second end connected to said rear vertical tube;

a second vertical side frame having a front vertical tube, a rear vertical tube and a center vertical tube positioned between said front and rear vertical tubes, a lower tube connecting said front, center and rear vertical tubes at the lower ends, a top tube connected a first end to said front vertical tube and at a second end to said center vertical tube, a front diagonal tube connected at an angle having a first end connecting to said front vertical tube and a second end connected to said lower tube, a second diagonal tube extending at an angle parallel to said first diagonal tube having a first end connected to said center vertical tube and a second end connected to said rear vertical tube;

a front cross tube connecting said front vertical tube of said first vertical side frame and said front vertical tube of said second vertical side frame;

a rear cross tube connecting said rear vertical tube and said first vertical side frame and said rear vertical tube of said second vertical side frame; and a platform member extending between said first vertical side frame and said second vertical side frame, wherein said platform member is slidably connected to said front diagonal tube and said rear diagonal tube of said first vertical side frame and said front diagonal tube and said rear diagonal tube of said second vertical side frame.

7. The hoist of claim 6 further comprising one or more roller assemblies connected between said platform member and each said front diagonal tube and said rear diagonal tube of said first vertical side frame and said second vertical frame, wherein said one or more roller assemblies facilitate the movement of said platform member along said front diagonal tube and said rear tube of said first vertical side frame and said front diagonal tube and said rear diagonal tube of said second vertical side frame.

8. The hoist of claim 6 further comprising a suspension operably connected to said platform for providing variation of location and the amount of load applied to said platform, without undue stress or fatigue to said platform and said first vertical side frame and said second vertical side frame.

9. The hoist of claim 6 wherein said suspension system comprises a winch mechanism connected to said first vertical side frame, a flexible cable connected at one end to said winch and at a second end to said platform member, a first wheel member connected on said first vertical side frame and a second wheel member connected on said second vertical side frame, wherein said flexible cable is threaded through said first wheel and said second wheel.

10. The hoist of claim 9 further comprising one or more additional wheel members for positioning said flexible cable along said hoist.

11. The hoist of claim 6 further comprising a mechanical winch attached to said first vertical tube of said first vertical side frame, a pulley block connected to said first vertical side frame, a second pulley block mounted to said second vertical side frame and one or more pulley blocks mounted to said platform, spaced as far apart as possible, and a flexible cable connected to said mechanical winch at one end and routed through said first, second pulley blocks mounted on said vertical frames and connected to said pulley blocks mounted on said platform.

* * * * *